US005531238A

United States Patent [19]

Azzarelli et al.

[11] Patent Number: 5,531,238

[45] Date of Patent: Jul. 2, 1996

[54] ATTACHMENT APPARATUS FOR A WALKER CADDY CONTAINER

[76] Inventors: Paul T. Azzarelli; Carol Azzarelli, both of 645 Magnus La., Coraopolis, Pa. 15108

[21] Appl. No.: 382,249

[22] Filed: Jan. 31, 1995

[51] Int. Cl.[6] ..... A45B 3/00

[52] U.S. Cl. ..... 135/66; 135/67; 220/482; 248/311.2; 248/215; 248/231.21; 224/409; 224/411; 224/550; 224/560

[58] Field of Search ..... 135/66, 67; 248/311.2, 248/215, 231.2, 225.31; 220/482, 481, 480; 224/409, 411, 560, 561, 546, 552, 553, 550

[56] References Cited

U.S. PATENT DOCUMENTS

| | | | |
|---|---|---|---|
| D. 308,497 | 6/1990 | Roche | D12/133 |
| D. 309,684 | 8/1990 | Kohler | D6/511 |
| D. 324,504 | 3/1992 | Olsen | D12/133 |
| D. 340,012 | 10/1993 | Azzarelli | D12/133 |
| 3,126,191 | 3/1964 | Holden | 248/225.31 X |
| 3,944,108 | 3/1976 | enik | 220/482 |
| 4,048,754 | 9/1977 | Laux | 220/482 X |
| 4,074,683 | 2/1978 | Di Chiara | 135/67 |
| 4,298,016 | 11/1981 | Garelick | 135/67 |
| 4,944,434 | 7/1990 | Hamilton | 248/215 X |
| 4,946,058 | 8/1990 | Stamm | 135/67 X |
| 4,974,760 | 12/1990 | Miller | 224/42.46 |
| 5,170,810 | 12/1992 | Chapin | 135/66 |
| 5,228,711 | 7/1993 | Semmans | 280/304.1 |
| 5,273,063 | 12/1993 | Farr et al. | 135/67 X |
| 5,275,187 | 1/1994 | Davis | 135/67 |

*Primary Examiner*—Lanna Mai
*Attorney, Agent, or Firm*—John D. Gugliotta

[57] ABSTRACT

An improved apparatus for attaching a walker caddy container to a conventional walker is provided, wherein the apparatus is easily adjustable, without additional adapters, to accommodate attachment to a variety of walker designs. The apparatus comprises a pair of hanger arms which are adjustable and which provide vertical support by hanging from a horizontal connecting member of the walker, while a pair of support arms provide horizontal support by pressing against one each of a pair of forward leg members of the walker. The support arms are attached to a rotatable disc positioned beneath the walker caddy container, thereby to provide extendable adjustability to the support arms in order to accommodate horizontal support against a variety of walker designs. The support arms are slidably mounted to the walker caddy container and are lockable into a desired position.

6 Claims, 5 Drawing Sheets

ATTACHMENT APPARATUS FOR A WALKER CADDY CONTAINER

BACKGROUND OF THE INVENTION

1. Field of the Invention

The present invention relates generally to an attachment apparatus for a walker caddy and, more particularly, to an attachment apparatus that is adjustable to accommodate a variety of walker designs.

2. Description of the Related Art

Many medical patients, elderly people, and the like need aid in moving about. Walkers are widely known aids for the aged, handicapped, injured or other individuals who require some stabilization while walking. When using a walker, both hands of the individual are needed in order to move the walker itself with each step taken. Therefore, it can be extremely difficult for walker users to carry other items with them.

Numerous attempts have been made to correct for the foregoing problems. For instance, U.S. Pat. No. Des. 340,012, issued in the name of Azzarelli, which is hereby incorporated herein by reference in its entirety, discloses the ornamental design for a walker caddy container. The inventor of this reference is the same inventor of the present invention herein. Additionally, U.S. Pat. No. Des. 324,504, issued in the name of Olsen, discloses the ornamental design for a carrier for use with a walker. Further, U.S. Pat. No. 4,974,760, issued in the name of Miller, discloses an article carrier attachable to a front brace of a walker and composed of a flexible material whereby the article carrier is foldable with the walker as the walker is collapsed for storage or transport.

However, the above references do not address the problem of attaching the walker caddy container to a variety of walker designs. As is well-known in the art, some walkers have a straight bar design, while other walkers have a V-bar design. This variety of walker designs prevents some walker caddy containers from being attached to some walker designs. Consequently, a need has been felt for providing an attachment apparatus for a walker caddy container that is adjustable to accommodate a variety of walker designs for efficient universal attachment thereto.

SUMMARY OF THE INVENTION

It is therefore an object of the present invention to provide an improved attachment apparatus for a walker caddy container that is adjustable to accommodate a variety of walker designs for efficient universal attachment thereto.

It is a feature of the present invention to provide an improved attachment apparatus that is adjustable by pivoting a support arm about a rotating disc.

It is a further feature of the present invention to provide an improved attachment apparatus that has a mounting bracket that receives a hanger arm in a one of a plurality of positions.

It is a further feature of the present invention to provide an improved attachment apparatus that provides a hanger arm that is vertically adjustable.

Briefly described according to one embodiment of the present invention, an improved apparatus for attaching a walker caddy container to a conventional walker is provided, wherein the apparatus is easily adjustable, without additional adapters, to accommodate attachment to a variety of walker designs. The apparatus comprises a pair of hanger arms which are adjustable and which provide vertical support by hanging from a horizontal connecting member of the walker, while a pair of support arms provide horizontal support by pressing against one each of a pair of forward leg members of the walker. The support arms are attached to a rotatable disc positioned beneath the walker caddy container, thereby to provide extendable adjustability to the support arms in order to accommodate horizontal support against a variety of walker designs. The support arms are slidably mounted to the walker caddy container and are lockable into a desired position.

Another preferred embodiment of the present invention provides an apparatus for attaching a container to a walker, which walker includes a first pair of legs having upper end portions and a first hand grip means connecting the upper end portions, a second pair of legs having upper end portions and a second hand grip means connecting the upper end portions of the second pair of legs, the first pair of legs spaced a predetermined distance from the second pair of legs, and a structural member connecting the upper end portion of one of the first pair of legs with the upper end portion of one of the second pair of legs to define a space within the walker bounded by the first and second pairs of legs, the apparatus for attaching the container comprising: hanger means for hanging the container from the structural member; support means for supporting the container against one of the first pair of legs and one of the second pair of legs; mounting means for mounting the hanger means and the support means to the container.

An advantage of the present invention is easy attachment to and detachment from a walker.

Another advantage of the present invention is adjustability to accommodate different walkers having a variety of different structural designs.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
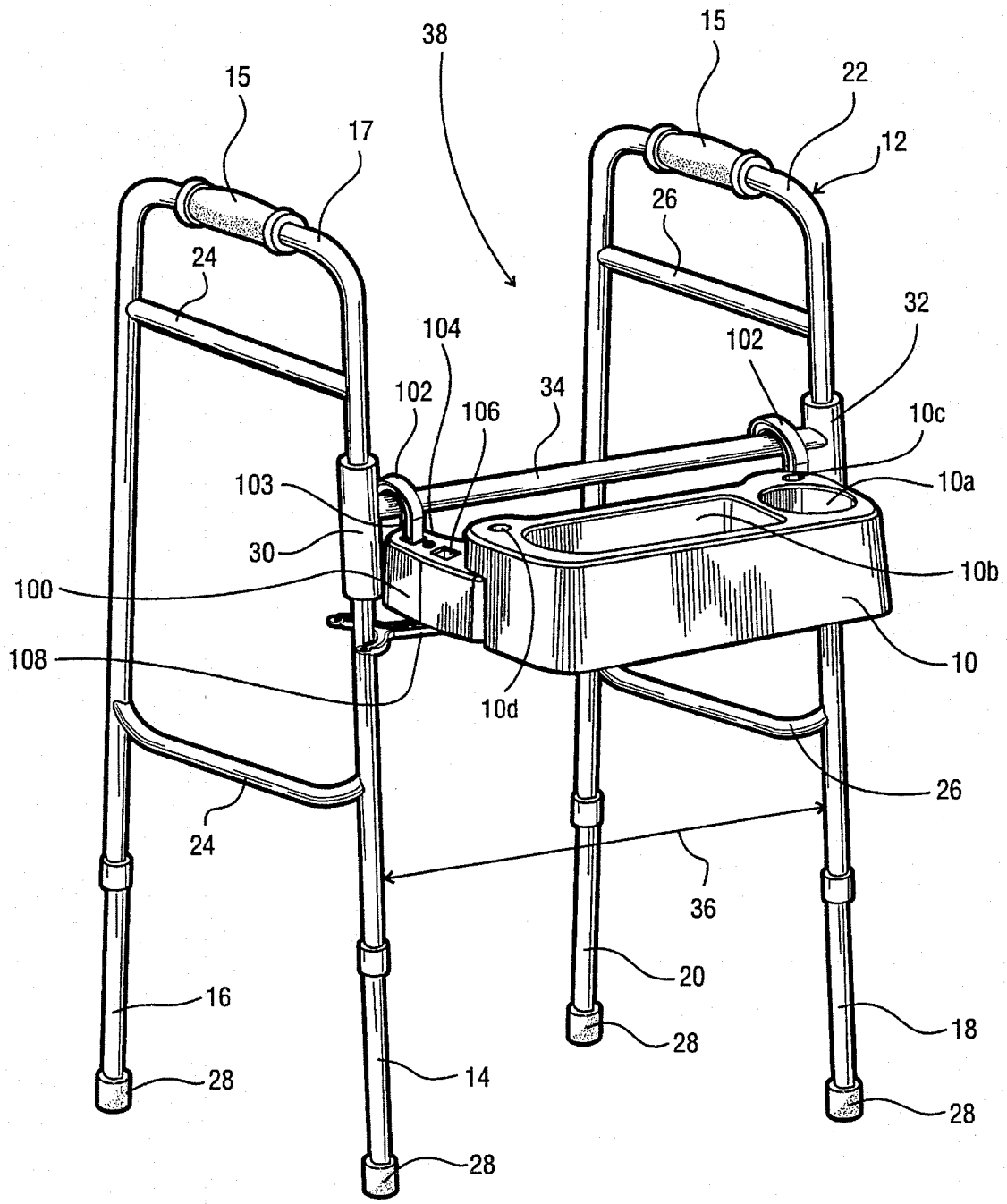
FIG. 1 is a perspective view of walker caddy container which has been removably attached to a walker with an attachment apparatus according to a preferred embodiment of the present invention.

Referring now to FIG. 1, there is shown generally a walker caddy container 10 which is removably attached to a conventional foldable walker 12. A preferred embodiment of the walker caddy container 10 defines therewithin a cylinder-shaped drink cup area 10*a*, a storage area 10*b*, and cylinder-shaped pencil areas 10*c* and 10*d*.

The walker 12 includes a first pair of generally vertical leg members comprising a forward leg member 14 and an aft leg member 16. The upper ends of the leg members 14 and 16 are joined by a generally horizontal connecting member 17 which may be a separate member connected thereto or, as shown, integral with the upper portions of the legs. The connecting member 17 may include a suitable hand grip 15 intermediate thereof. As used herein, the terms "vertical" and "horizontal" are meant to be relative to the upright position of the walker 12 and caddy container 10, as shown in FIG. 1, for ordinary use. The walker 12 also includes a second pair of leg members comprising a forward leg member 18 and an aft leg member 20 which are similar to leg members 14 and 16 and the upper ends of which are suitably connected by a connecting member 22 which is similar to connecting member 17 and which may also include a suitable hand grip 15. A pair of members 24 may be suitably connected between and intermediate the ends of the first pair of leg members 14 and 16 for structurally stabilizing, i.e. bracing, thereof. Similar bracing members 26 may be suitably attached between and intermediate the ends of the second pair of leg members 18 and 20. Each of the leg members may be provided with suitable rubber feet 28 for contacting the floor.

A sleeve 30 circumferentially surroundingly engages the upper portion of forward leg member 14 and is circumferentially slidable thereabout. A similar sleeve 32 similarly engages the forward leg 18. A brace member 34 extends between and is suitably and rigidly attached to the upper portions of the sleeves 30 and 32. Suitable means (not shown), which are conventionally known in the art, are provided to lock the positions of the forward leg members 14 and 18 circumferentially relative to the respective sleeves 30 and 32 to the open position of the walker 12 for use as shown in FIG. 1, the locking means being releasable to allow circumferentially slidable movement of the forward legs 14 and 18 within the respective sleeves 30 and 32 for collapsing or folding the walker for storage or transportation thereof such as in the trunk of an automobile or the like. The walker 12 which has been described may be of any suitable shape and size, and such walker are conventionally known to those of ordinary skill in the art to which this invention pertains. For example, to accommodate most adults, each of the legs 14, 16, 18, and 20 may have a height of perhaps 30 to 38 inches, the distance between each forward leg member and the respective aft leg member at the upper portions thereof may be perhaps 11 inches, and the length of the brace member 34 may be perhaps 16 inches, whereby the first pair of leg members 14 and 16 is spaced from the second pair of leg members 18 and 20, when the walker 12 is open and ready for use, a distance 36, which is equal to perhaps 16 inches (equal substantially to the length of the brace 34). Thus, a space 38, of perhaps 11 inches by 16 inches in a horizontal plane is provided between the pairs of leg members and rearwardly of the brace member 34 in which space 38 a user may position his or her body while standing. It is to be understood that the composition and sizing of the walker 12 may be different from that shown in FIG. 1. For instance, the brace member 34 may form a "V-bar" between the forward leg members 14 and 18. Further, the forward leg members 14 and 18 may be parallel to the aft leg members 16 and 20, respectively. Moreover, the forward leg members 14 and 18 may be sloped relative to the aft leg members 16 and 20, respectively.

Referring to FIG. 1, a pair of mounting brackets 100 is affixed to the walker caddy container 10. The mounting brackets 100 accept a pair of hanger arms 102 in a plurality of orifices 104 and 106, respectively. The pair of hanger arms 102 have a square shape 103 at a top portion thereof, thereby to be slidingly engaged within one of the plurality of orifices 104 and 106, which are also square-shaped, thereby to prevent rotatable movement of the hanger arm 102 therewithin. A molded support arm 108 and 110 (see FIG. 2) extends outwardly from beneath each of the pair of mounting brackets 100.

Figure 2:
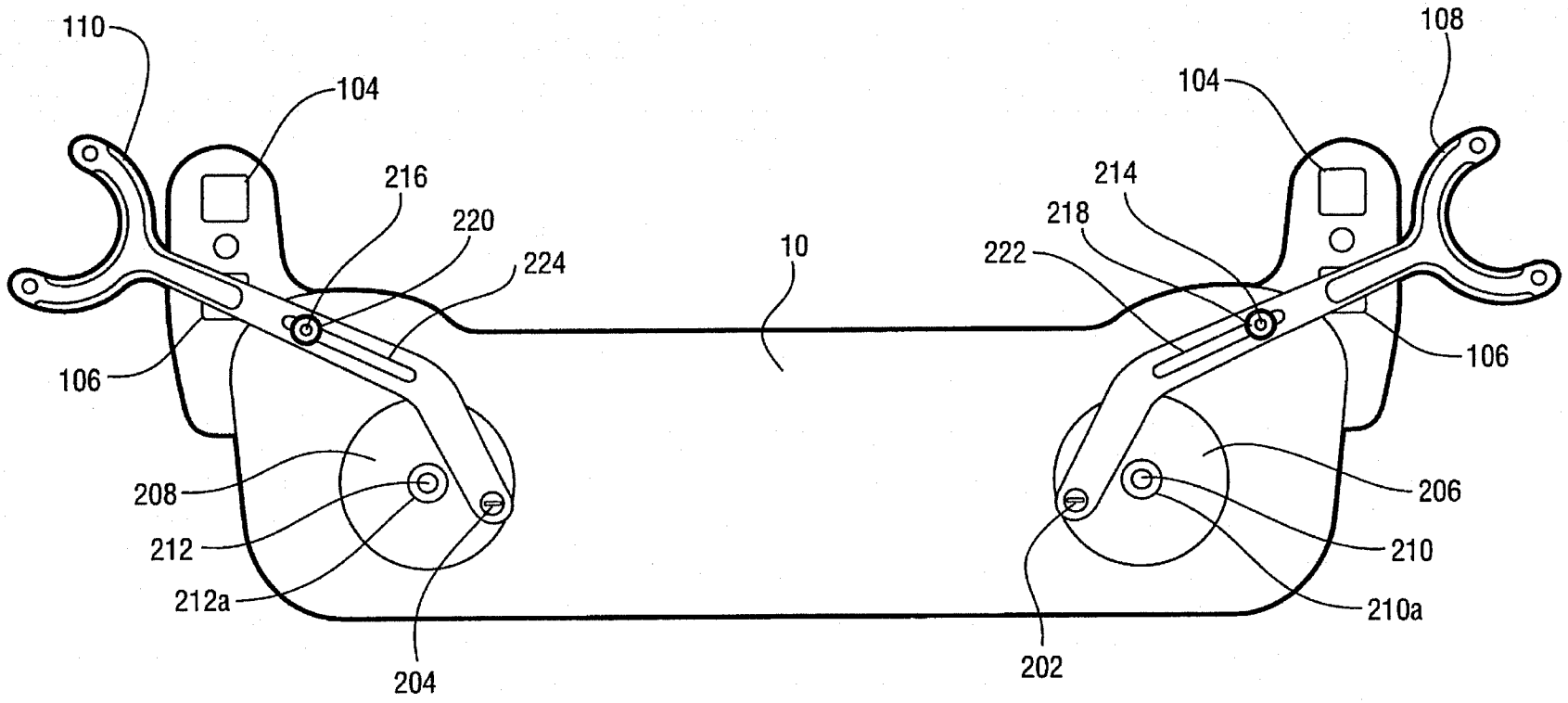
FIG. 2 is a bottom plan view of the walker caddy container showing the attachment apparatus according to a preferred embodiment of the present invention.
Figure 3:
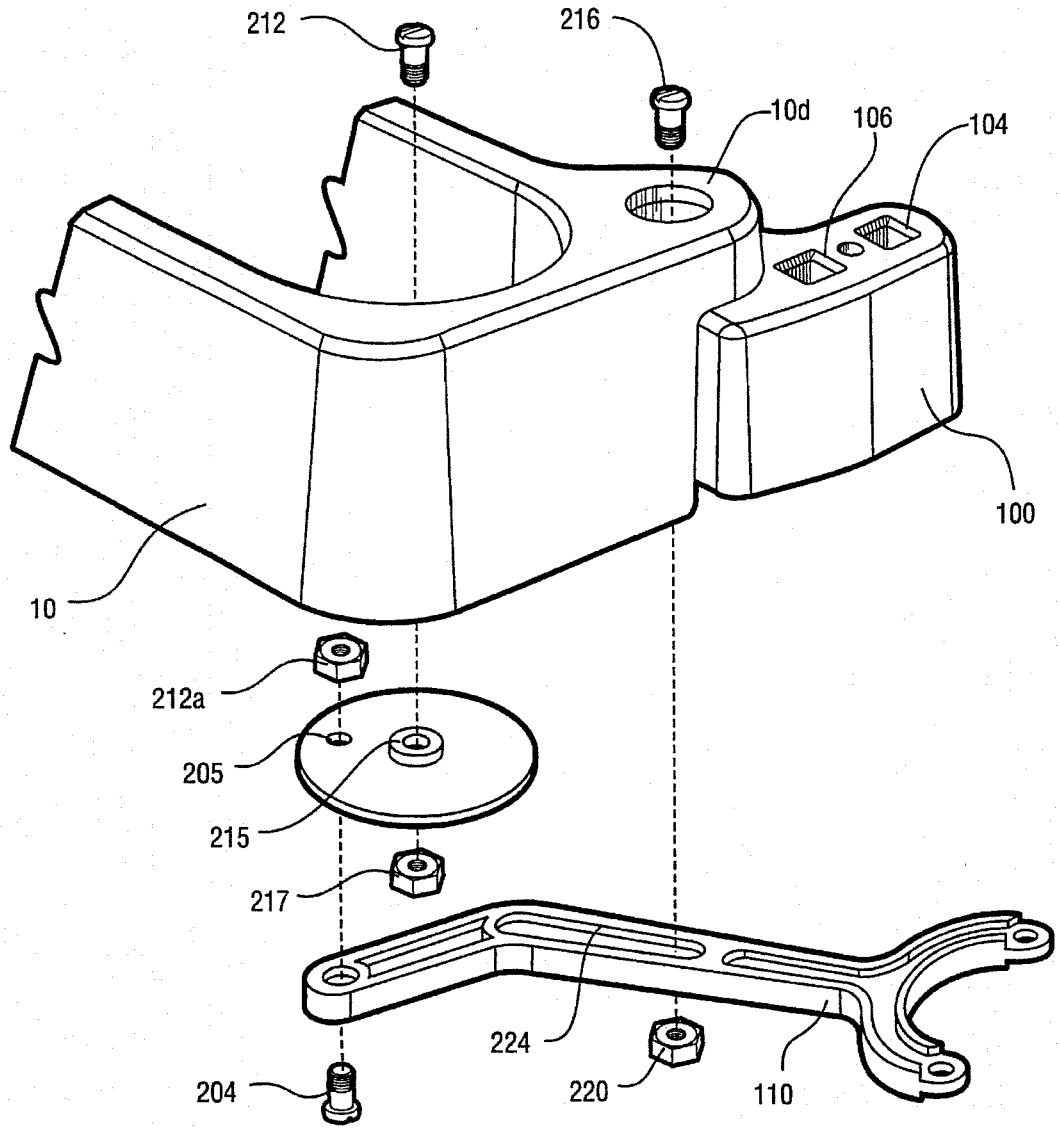
FIG. 3 is an exploded perspective view of the molded support arm and associated disc according to a preferred embodiment of the present invention.

Referring to FIGS. 2 and 3, a bottom plan view of the pair of mounting brackets 100, as affixed to the walker caddy container 10 is shown in FIG. 2. An exploded perspective view of the mounting bracket 100 affixed to a partial walker caddy container 10 is shown in FIG. 3. The pair of hanger arms 102 are not shown. The molded support arms 108 and 110 are rotatably affixed with a bolt 202 and 204, respectively, through an orifice (not shown) and an orifice 205 respectively, proximal to an outer radius of a disc 206 and 208 respectively, which discs 206 and 208 are rotatably affixed to the walker caddy container 10 about an axle bolt 210 and 212, respectively. The bolt 204 is threaded into a nut 213, and the bolt 202 is similarly threaded into a nut (not shown). The axle bolt 212 is threaded through an orifice 215 and into a nut 217. The axle bolt 210 is similarly threaded into a nut (not shown). Additionally, the molded support arms 108 and 110 are slidably mounted upon a bolt 214 and 216 respectively, each of which is threaded through the cylinder-shaped pencil area 10*c* and 10*d* respectively (see FIG. 3) and affixed with a nut 218 and 220 respectively, thereby to adjustably extend and retract the support arm 108 and 110 from the pair of mounting brackets 100 by permitting slidable movement of the support arms within a defined slot 222 and 224 respectively, wherein the nut 218 and 220 may be tightened against the support arm 108 and 110 in order to restrict the slidable movement thereof.

Figure 4:
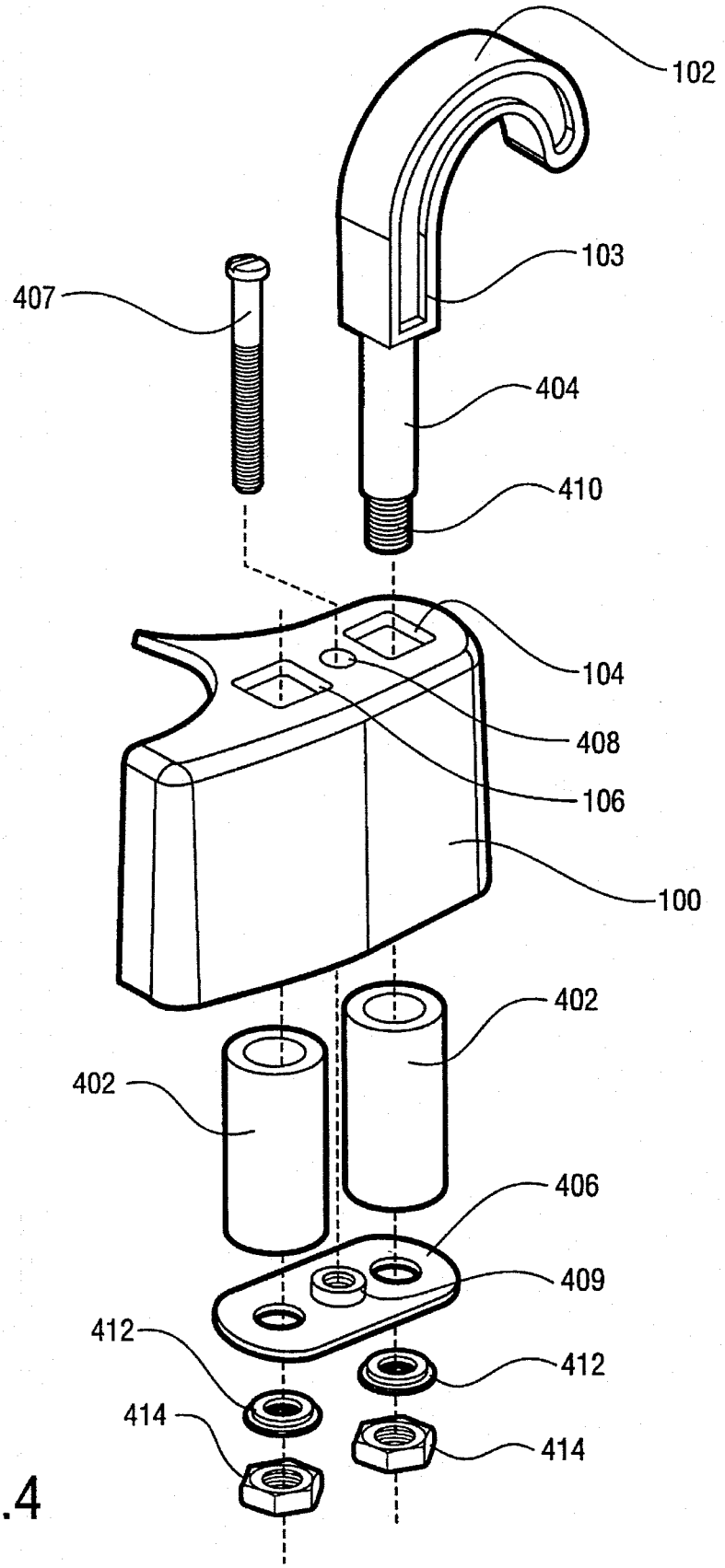
FIG. 4 is an exploded perspective view of the mounting bracket and hanger arm with associated hardware, according to a preferred embodiment of the present invention.

In FIG. 4, an exploded perspective view of the mounting bracket 100 and hanger arm 102 with associated hardware is shown, according to a preferred embodiment of the present invention. The mounting bracket 100 houses a pair of spacers 402, one each of which is positioned beneath the plurality of orifices 104, 106, thereby to receive a cylindrical shaft 404 which extends from the square shape 103 of the top portion of the hanger arm 102 when the cylindrical shaft 404 is inserted into one of the plurality of orifices 104, 106. A stamped steel plate 406, which is positioned beneath the spacers 402, is held into place within the mounting bracket 100 by threading a machine screw 407 into a machine screw orifice 408, through the mounting bracket 100, and into a threaded orifice 409 within the stamped steel plate 406. The cylindrical shaft 404 has sufficient length to extend through either one of the spacers 402 and through the stamped steel plate 406, thereby to extend a threaded end 410 through the stamped steel plate 406. The threaded end 410 receives one of a pair of nylon washers 412 prior to receiving a nut 414 threaded thereon. The hanger arm 102 is vertically adjustable by moving the nylon shoulder washer 412 along the threaded end 410 and subsequently tightening the nut 414 thereagainst the nylon shoulder washer 412.

Figure 5:
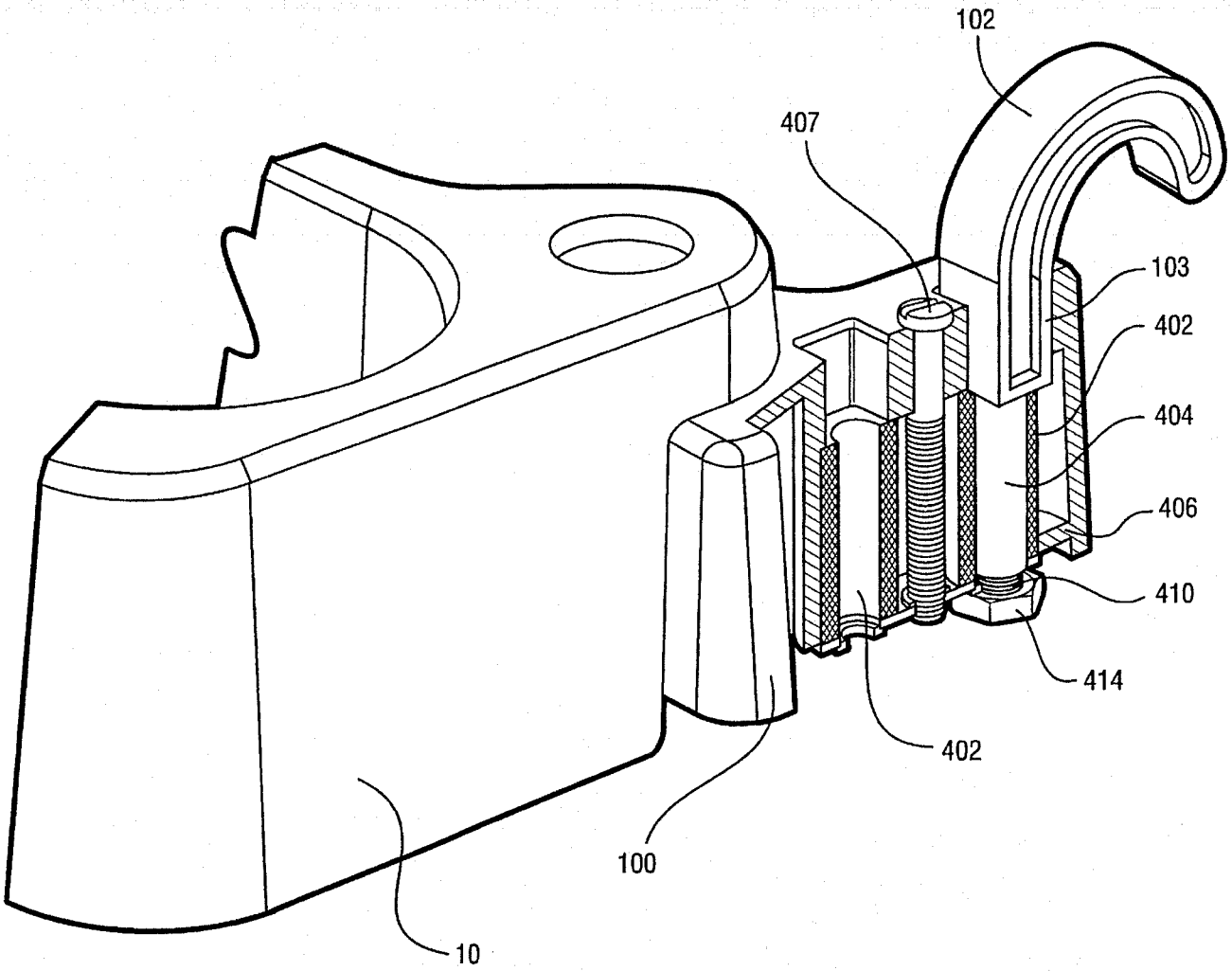
FIG. 5 is a partial cross-section of the mounting bracket of FIG. 4.

FIG. 5 shows a partial cross-section of the mounting bracket 100, taken along the line V—V of FIG. 4, wherein the mounting bracket 100 is affixed to a partial perspective view of the walker caddy container 10, and the hanger arm 102 is shown in full perspective view seated properly within the cross-sectional view of the mounting bracket 100.

2. Operation of the Preferred Embodiment

In operation, the support arms 108 and 110 are adjusted accordingly to extend outwardly from the walker caddy container 10, thereby to press against the forward leg member 114 and 118, respectively, in order to horizontally support the walker caddy container 10 against the conventional walker 12. The adjustment is made by rotating the respective disc 206 and 208 in order to urge the support arm 108 and 110 along slidable movement within the respective slots 222 and 224, thereby to alternately extend and retract the support arm 108 and 110 from beneath the walker caddy container 10. Upon proper adjustment to fit the conventional walker 10, the nut 218 and 220 is tightened against the support arm 108 and 110, respectively, in order to restrict the slidable movement thereof within the respective defined slots 222 and 224.

Subsequently, the pair of hanger arms 102 is fitted within the plurality of orifices 104 and 106, depending upon the width of the connecting member 17, thereby to be adjustable to a variety of widths of connecting member 17. The hanger arms 102 are passed through the spacers 402 positioned within the mounting brackets 100, and are affixed to the mounting brackets 100 by threading the nut 414 thereupon beneath the mounting bracket 100. The walker caddy container 10 is attached to the conventional walker 12 by being vertically supported by hanging from the connecting member 17 with the hanger arm 102 while the support arms 108 and 110 horizontally support the walker caddy container 10 by pressing against the forward leg member 14 and 18, respectively. In this position, the present invention is easily removable from the conventional walker 12 and easily adjustable to accommodate a variety of walker designs, such as those with a straight bar design and those with a V-bar design.

The foregoing description of the preferred embodiment of the present invention has been presented for purposes of illustration and description. It is not intended to be exhaustive or to limit the present invention to the precise form disclosed, and obviously many modifications and variations are possible in light of the above teachings.

The preferred embodiment was chosen and described in order to best explain the principles of the present invention and its practical application to those persons skilled in the art, and thereby to enable those persons skilled in the art to best utilize the present invention in various embodiments and with various modifications as are suited to the particular use contemplated. It is intended that the scope of the present invention be broadly defined by the claims which follow.

What is claimed is:

1. In a walker having a first pair of legs having upper end portions and a first hand grip means connecting the upper end portions, a second pair of legs having upper end portions and a second hand grip means connecting the upper end portions of the second pair of legs, the first pair of legs spaced a predetermined distance from the second pair of legs, and a structural member connecting the upper end portion of one of the first pair of legs with the upper end portion of one of the second pair of legs to define a space within the walker bounded by the first and second pairs of legs, and a walker caddy container, the improvement comprising:

hanger means for hanging said walker caddy container from said structural member;

mounting means affixed to said hanger means for mounting said hanger means to said container;

a disc with an outer radius, wherein said disc is rotatably affixed to a bottom portion of said container; and a support arm having a first end, a central portion, and a second end, wherein said first end is rotatably affixed to said disc proximal to said outer radius, and wherein said central portion is slidably mounted to said bottom portion of said container, thereby to extend said second end outwardly from said container when said disc is rotated in a first direction, and to retract said second end inwardly toward said container when said disc is rotated in a second direction which is opposite said first direction.

2. The improvement according to claim 1, wherein said hanger means is a hooked arm which is vertically adjustable within said mounting means.

3. The improvement according to claim 1, wherein said mounting means comprises:

a spacer;

a steel plate;

a nylon shoulder washer; and a threaded nut, and wherein said hanger means is inserted through said spacer, said steel plate, and said nylon shoulder washer, thereby to be threaded into said threaded nut.

4. The improvement according to claim 3, wherein said hanger means is adjustable by moving said nylon shoulder washer along said hanger means and tightening said threaded nut thereagainst said nylon shoulder washer.

5. An apparatus for use with a walker caddy container for attaching said container to a walker which walker includes a first pair of legs having upper end portions and a first hand grip means connecting the upper end portions, a second pair of legs having upper end portions and a second hand grip means connecting the upper end portions of the second pair of legs, the first pair of legs spaced a predetermined distance from the second pair of legs, and a structural member connecting the upper end portion of one of the first pair of legs with the upper end portion of one of the second pair of legs to define a space within the walker bounded by the first and second pairs of legs, the apparatus for attaching the container comprising:

hanger means for hanging the container from the structural member;

support means affixed to said container for supporting said container against one of said first pair of legs and one of said second pair of legs wherein said support means comprises a support arm and a disc rotatably affixed beneath the container, wherein said support arm is rotatably affixed to said disc along an outer radius of said disc, and said support arm is slidably affixed to the container, thereby to permit adjustable extension from and retraction into said mounting means by rotating said disc; and mounting means connected to said hanger means for mounting said hanger means to the container.

6. An apparatus for use with a walker caddy container for attaching a walker caddy container to a walker having a first pair of legs joined by a connecting member to a second pair of legs, wherein the apparatus is adjustable to be attached to a variety of walker structural designs, and wherein the apparatus comprises:

hanger means affixed to said walker caddy container for hanging said container from said connecting member; and support means affixed to said walker caddy container for supporting said container against one of said first pair of legs and one of said second pair of legs, wherein said support means comprises:

a disc with an outer radius, wherein said disc is rotatably affixed to a bottom portion of said container; and a support arm having a first end, a central portion, and a second end, wherein said first end is rotatably affixed to said disc proximal to said outer radius, and wherein said central portion is slidably mounted to said bottom portion of said container, thereby to extend said second end outwardly from the walker caddy container when said disc is rotated in a first direction, and to retract said second end inwardly toward the walker caddy container when said disc is rotated in a second direction which is opposite said first direction.

* * * * *